US005105743A

United States Patent [19]

Tano et al.

[11] Patent Number: 5,105,743

[45] Date of Patent: Apr. 21, 1992

[54] METHOD AND DEVICE FOR INTRODUCTION OF EXPLOSIVES INTO DRILL HOLES

[76] Inventors: Christer Tano, Blomstervägen 2A, S-771 00 Ludvika; Bengt Radman, Ryktarvägen 10, S-772 00 Grängesberg, both of Sweden

[21] Appl. No.: 324,218

[22] Filed: Mar. 15, 1989

[30] Foreign Application Priority Data

Mar. 15, 1988 [SE] Sweden ..... 8800921

[51] Int. Cl.[5] ..... F42B 3/00; F42D 3/00

[52] U.S. Cl. ..... 102/313; 86/20.15; 299/13

[58] Field of Search ..... 102/312, 313, 323, 324, 102/331; 86/20.15; 299/13; 166/63; 175/62

[56] References Cited

U.S. PATENT DOCUMENTS 4,036,099 6/1977 French ..... 86/20
4,090,447 5/1978 Johnsen ..... 102/23
4,699,060 10/1987 Vuillaume et al. ..... 102/313

FOREIGN PATENT DOCUMENTS 746111 7/1980 U.S.S.R. .
883420 11/1981 U.S.S.R. ..... 299/13

*Primary Examiner*—Brooks H. Hunt
*Assistant Examiner*—Chrisman D. Carroll
*Attorney, Agent, or Firm*—Notaro & Michalos

[57] ABSTRACT

In a method and a device for introducing granular or pulverulent explosive into drill holes the introduction is suitably carried out by means of a hose like or tube like conduit (2) introducable into the drill hole, the explosive being transported through the conduit, e.g. with pressurized air. To obtain an explosive power reduced in relation to that obtained by complete filling of the drill holes with the explosive, only partial filling of the drill holes is carried out by either a) providing the conduit (2) with a tool (12), which on withdrawal of the conduit out of the drill hole leaves an air filled cavity in the drill hole, or b) arranging in the drill hole elongated filler means (24) and carrying out feeding of the explosive while said means is located within the drill hole.

13 Claims, 4 Drawing Sheets

METHOD AND DEVICE FOR INTRODUCTION OF EXPLOSIVES INTO DRILL HOLES

FIELD OF INVENTION AND PRIOR ART

This invention is related to a method for introduction of explosives into drill holes, said introduction suitably being carried out by means of a hoselike or tubelike conduit introducable into the drill hole, through which conduit the explosive is transported, e.g. by pressurized air. In addition, the invention is related to a device for carrying out the method.

The explosive materials to be used in accordance with the invention are generally speaking bulk explosive materials comprising, but not limited to, granular and pulverulent explosives, slurry explosives and emulsion explosives. The granular and pulverulent explosives are the most preferred.

In drifting or tunnel blasting in rock, a large number of holes is drilled or bored in the rock portion to be blasted away. In order to obtain efficient blasting of the rock, one uses for blasting of the central drill holes in the drift or tunnel intended a detonator at the bottom of the drill holes and a granular or pulverulent explosive which is caused to entirely fill the drill holes. The type of explosive most commonly used for this purpose is denoted ANFO. This is a pulverulent explosive composed by prilled ammonium nitrate mixed with diesel oil and sold for instance under the trade mark PRILLIT by Nitro-Nobel AB, Gyttorp. This explosive is relatively non-expensive and has the desired explosive power. In the outer areas of the drift or tunnel intended, it is desirable to carry out blasting in the rim holes located therein with a reduced loading concentration, i.e. a smaller explosive power per drill hole meter. The reason therefore is that one wishes to reduce the fissure zone in the remaining rock to a minimum. For drilling technical reasons it is not a possible way to simply reduce the diameter of the rim drill holes so far that they could be completely filled by for instance PRILLIT. One does namely normally operate with drill hole diameters for the rim holes and for the rest also for the main part of all drill holes within the interval 38–48 mm since this allows use of highly efficient drill crowns and drilling machines. In order to reduce the explosive power in the rim holes to the desired level, one would have to go down to a drill hole diameter of for instance in the range 18–25 mm, which would considerably reduce the drilling productivity due to the equipment then necessary. For this reason one uses for blasting the rim holes so called tube blasting charges, in which the explosive is housed within rigid plastic tubes, which on introduction into the drill holes are joined to the desired total length. Such tube charges comprise members abutting against the drill hole wall to locate the tube charge in the center of the drill hole. Such tube charges may for instance contain a pulverulent nitroglycerine/nitro glycol sensibelized special explosive. They are available on the market from Nitro-Nobel AB under the trade marks GURIT and NABIT and from Kimit AB under the trade mark KIMIT. Such tube charges operate very well per se since they enable adaptation of the relatively low explosive power in the drill hole rows located closest to the rock areas which are to remain after the blasting. The problem with tube charges is that they are very expensive. In the cost situation of today, the cost for blasting a drill hole with a diameter of 41 mm and a length of 3.5 meter is about 16 crowns higher per drill hole when using tube charges as compared to an explosive of ANFO-type. One has therefore tried to use ANFO explosives also for the rim holes. In order to reduce the explosive power to the desired degree, one has tried to dilute the ANFO-explosive with granular or pulverulent filling agents, e.g. balls of foamed plastics. However, these efforts have not turned out to be successful; problems have arisen due to the difficulty in maintaining the explosive and the filling agent in uniform mixture. Accordingly, it has turned out that separation appears so that varying loading concentration occurs along the length of the drill hole. This leads to uneven and accordingly deficient blasting result. Therefore, one has in practice continued to use tube charges when there is a need for reduced explosive power.

SUMMARY OF THE INVENTION

The object of the invention is to devise ways to use relatively non-expensive explosives, e.g. of ANFO-type, also in such cases where the drill holes in question due to established loading concentration limits may not be filled entirely with such explosives.

To meet with this object, it is according to the invention proposed that one for obtaining an explosive power reduced in relation to that obtained by complete filling of the drill holes with the explosive carries out only partial filling of the drill holes by either a) providing the conduit with a tool, which in connection with feeding of the explosive into the drill hole and successive or stepwise withdrawal of the conduit therefrom leaves an air filled elongated cavity in the drill hole, or b) providing in the drill hole elongated filler means and carrying out feeding of the explosive into the drill hole so as to obtain by the volume of said filler means an elongated drill hole portion unfilled with explosive upon withdrawal of the conduit.

Accordingly, the volume of the longitudinal cavity in the drill hole and said filler means respectively is adjusted so that the explosive's volume which is required for achieving the blasting effect aimed at is obtained in the drill hole. Thus, the invention enables use of non-expensive explosives of for instance ANFO-type for all drill holes in the drifting or tunnel blasting, whereat the explosive power for different drill holes may be easily modified by using different sizes and designs of the tools and filler means respectively. Excellent results have been noted in practical tests when blasting ANFO-explosive to a height of only 18 mm in drill holes having diameters of for instance about 41 mm. This is surprising since manufactures of such ANFO-explosives themselves define the smallest allowed cross sectional dimension of an ANFO-charge to 30 mm for a good balsting result. The provision of the air filled longitudinal cavity in the drill hole may possibly according to a theory act favourably for obtaining entirely safe detonation despite the fact that the recommendations of the manufacturers have not been followed; these recommendations are based on complete filling of the drill holes. The whirling of explosive occurring in the air filled longitudinal cavity may possibly act favourably in achieving the entirely satisfactory detonation safety.

BRIEF DESCRIPTION OF THE DRAWINGS

With reference to the appended drawings, a more specific disclosure of embodiment examples of the invention will follow hereinafter.

In the drawings.

DETAILED DESCRIPTION OF PREFERRED EMBODIMENTS

Figure 1:
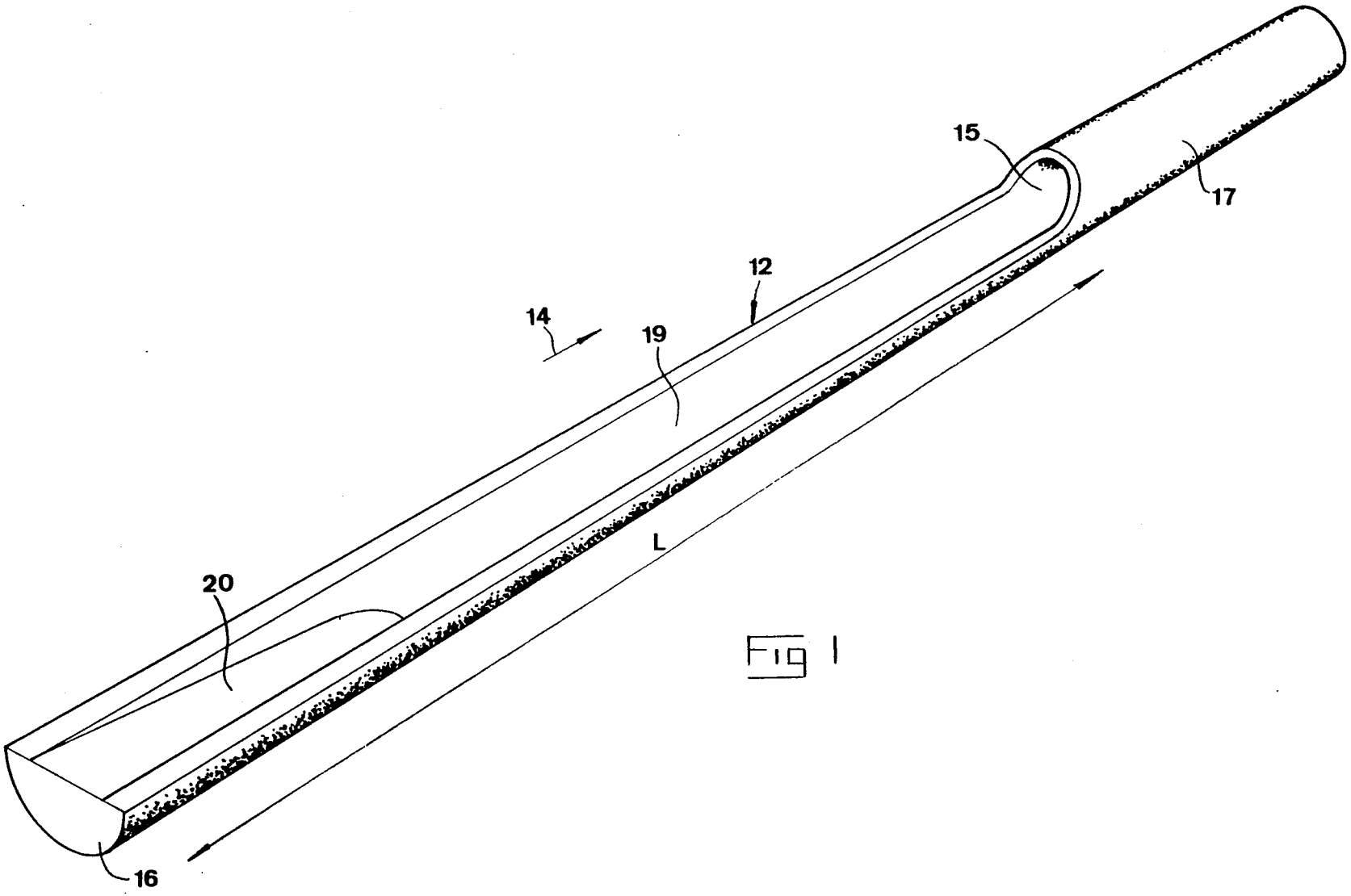
FIG. 1 is a perspective view of the tool according to the invention for introducing explosives into drill holes.

A device for introducing bulk explosives, in particular of the ANFO-type indicated hereinabove, e.g. PRILLIT, comprises as diagrammatically indicated in FIG. 3 an arrangement 1 driven by pressurized air for feeding the explosive through a hose like or tube like conduit 2, which is introducable into the drill hole 3 in question. The arrangement 1 comprises in the embodiment a container 4, in which the explosive is received. A fan or compressor 5 provides via a pipe 6 application of an over-pressure state within container 4 in that pipe 6 opens into the container above the level of explosives therein. The over-pressure in container 4 is controlled manually or automatically by suitable valve equipment 7. In the bottom of container 4 there is provided an outlet, in connection with which a diagrammatically indicated ejector 8 of suitable kind is arranged. This ejector is supplied with pressurized air from a fan or compressor 9 via a pipe 10, in which also a suitable pressure control valve 11 is arranged. The air flow in pipe 10 brings with it in the ejector 8 the granular or pulverulent explosive from the container 4 and the explosive is fed via conduit 2 into the drill hole 3.

In order to obtain an explosive power which is reduced in relation to that obtained by complete filling of the drill holes 3 with explosive, the device is adapted for partial filling of the drill holes by the conduit 2 being provided with a tool 12, which in connection with feeding of the explosive into the drill hole and successive or stepwise withdrawal of the conduit therefrom is adapted to leave an air filled longitudinal cavity 13 in the drill hole.

The tool 12 comprises a cavity forming portion 16, which is located behind the discharge opening 15 of the conduit as viewed in the withdrawal direction (arrow 14, see also FIG. 1) of the conduit 2 and the cross sectional area of which substantially corresponds to the cross sectional area of the desired cavity 13 in the drill hole.

The feeding arrangement 1 is adapted to feed the explosive through the conduit 2 and discharge opening 15 with a feeding pressure, which is adjusted or adjutable so low that the cavity 13 obtained behind the portion 16 as viewed in the direction of the arrow 14 is maintained on withdrawal of the conduit 2 and tool 12 out of the drill hole. More specifically, the tool 12 has the character of a nozzle member, which has the cavity forming portion 16 and the discharge opening 15 located at a considerable mutual distance in the longitudinal direction of the drill hole 13. This distance is suitably at least five times the internal diameter d before the discharge opening 15, preferably at least 10 times this diameter d. In the embodiment, the distance, indicated by the extent L in FIG. 1, is somewhat more than 20 times larger than the diameter d.

The tool or nozzle member 12 comprises a tube portion 17, which forms part of the conduit 2 and is connected to said conduit 2 for the rest by means of a suitable coupling 18.

The tool 12 as well as the conduit 2 for the rest are suitably of a design to avoid static electricity. The tool 12 and conduit 2 may for instance consist of a rubber or plastics material having mixed therein components imparting them electrical conductivity counteracting static charges.

Connection means 19 of the tool interconnect the tube shaped portion 17 comprising the opening 15 and the cavity forming portion 16. Said connection means may comprise a channel shaped portion 19. The cross sectional area of the connection means 19 is preferably smaller than the cross sectional area of the tube portion 17 and the cavity forming portion 16.

The tube shaped portion 17 of the tool 12 merges at the discharge opening 15 into the channel shaped portion 19, which need not be located open upwardly as illustrated in the drawings. The portion 19 comprises at its end turned away from the discharge opening 15 the cavity forming portion 16, which at or in the vicinity of the extreme end of the tool 12 has a cross sectional area, in the embodiment substantially semi circular, exceeding that of the channel shaped portion 19. This increased cross sectional area at the extreme end of the tool 12 is in the embodiment obtained in that the internal depth of the cannel decreases at the extreme end of the tool. In the embodiment, this decrease is successive in that a material portion 20 forms a rise from the bottom of channel 19 to the extreme end of the tool, where the channel 19 entirely ceases to exist.

It appears from the above description that the expression "discharge opening", relating to the designation 15 means that the material at the opening no longer is within a tubularly closed portion but instead the explosive is at the opening 15 free to move not only forwardly in channel portion 19 but also sidewardly and upwardly, i.e. that the drill hole 3 from the discharge opening 15 and opposite to the direction of arrow 14 may be filled with explosive with exception for the volume of the tool 12 per se behind the discharge opening 15.

The tool 12 may be produced starting from a tube, from which a longitudinal portion is cut away, so that the shape illustrated in FIG. 1 is obtained. The material portion 20 may then in the form of a loose material piece be laid into the channel 19 obtained and be secured therein, e.g. by glueing. However, it is also possible to produce the tool to final shape in one piece, e.g. by an injection molding process.

Figure 2:
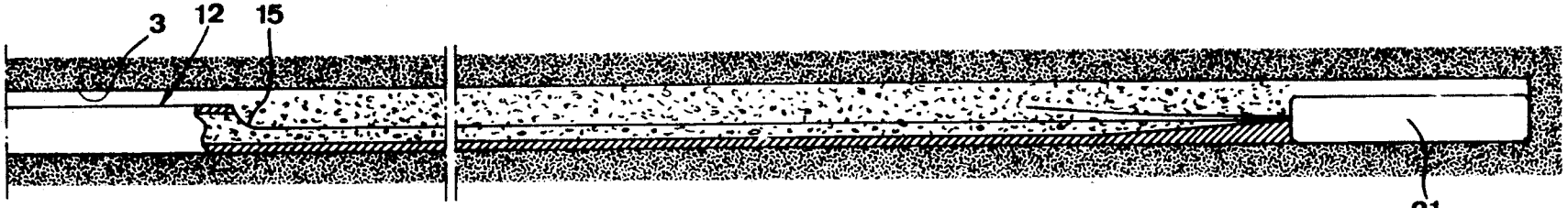
FIG. 2 is a partially cut side view of the tool in the initial phase of introduction of the explosive.
Figure 4:
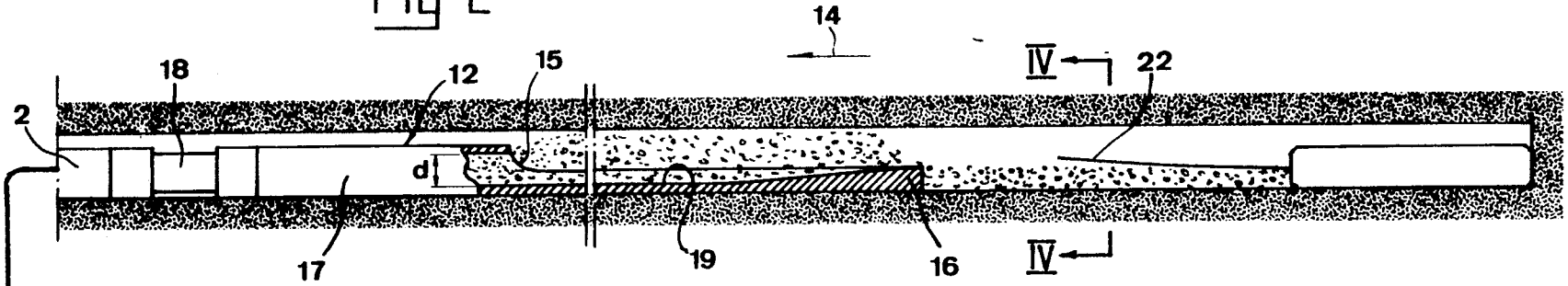
FIG. 4 is a cross section according to the line IV—IV in FIG. 3.
Figure 4:
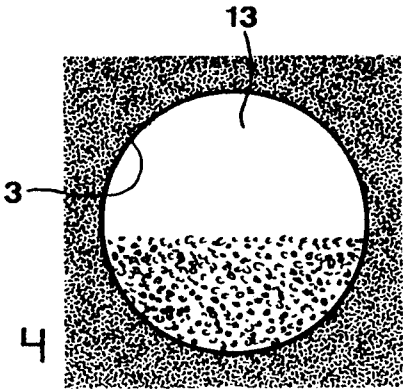

The embodiment according to FIGS. 1–4 is used in the following way: initially a detonator is introduced to the bottom of the drill hole 3, for instance a dynamite cartridge of the trade mark DYNAMEX (available from Nitro-Nobel AB) having a velocity of detonation of 5,500 m/sec. The dynamite cartridge denoted 21 is initiated electrically by means of partially indicated conductors 22. Thereafter the conduit 2 with the tool 12 at the extreme end is introduced into the drill hole. The tool 12 is introduced against the dynamite cartridge 21 at the bottom of the drill hole as indicated in FIG. 2 and thereafter the feeding arrangement 1 is put into operation so that the pulverulent explosive, e.g. PRILLIT with a velocity of detonation of about 3,000 m/sec, is fed through the conduit 2 and the tool 12. The explosive exits through the discharge opening 15 and is fed forwardly towards the bottom of the drill hole along channel portion 19. The tool 12 is maintained stationary at the bottom of the drill hole until the operator holding in the hose senses that the feed of explosive through conduit 2 has ceased, the explosive then filling the bottom portion of the drill hole 3, however with exception for the space above the cartridge 21, in a manner appearing by FIG. 2. When the filling has occured as far as indicated in FIG. 2, the relatively low feeding pressure in conduit 2 is no longer capable of introducing additional explosive into the drill hole but only feeding air moves through the conduit 2 and out through the discharge opening 15 to thereafter flow to the left in the drill hole 13 and out through the mouth thereof. If the operator wishes to have a more initmate filling of explosive just about the cartridge 21 proper, he may displace the conduit 2 and accordingly the tool 12 one or some times back and forth so that the forward end of the tool 12 which in the embodiment is illustrated as forming a generally transverse surface, pushes the explosive towards the cartridge 21 and substantially entirely fills the drill hole about the cartridge. The operator thereafter pulls back the conduit 2 somewhat in the direction of arrow 14, e.g. to the position according to FIG. 3. This results in explosive falling down, with the illustrated orientation of the tool, over the cavity forming forward portion 16 of the tool and laying on the bottom of the drill hole whereas above the explosive the longitudinal cavity 13 is formed. When the operator has pulled back the conduit 2, explosive again starts to enter out through the discharge opening 15 until the space between the discharge opening 15 and portion 16 is substantially entirely filled. However, the feeding pressure should be adjusted so low that it does not cause the explosive to pass over the portion 16 and thereby make the cavity 13 smaller than required. Since the tool at the portion 16 has a larger cross sectional area than in the zone between this portion 16 and the opening 15, the portion 16 will form a restriction of the open width of the drill hole, said restriction counteracting movement forwardly of the explosive past the portion 16. When the operator feels that explosive is no longer fed through the conduit 2, he continues the displacement of tool 12 in the direction of arrow 14 in the described manner until the drill hole along its entire length has been provided with explosive in the manner indicated in FIG. 4. The operator may also continously pull the conduit 2 and tool 12 in the direction of arrow 14 but this should then occur so slowly that a sufficient amount of the explosive is fed out into the drill hole. In practical tests it has been found that a very accurate dosage of explosive is obtained by the tool 12 according to the invention, the cross sectional area of the cavity 13 generally corresponding to the largest cross sectional area of the portion 16 of the tool. By changing between different tools 12 having different cross sectional area on their portion 16, the cross sectional area of the cavity 13 in the drill hole may accordingly be accurately determined.

It appears from the description hereinabove that the invention as far as it has been described until now is particularly suitable for "substantially horisontal drill holes". With the cited expression drill holes are in view, which do not deviate more from horisontal direction than that the explosive chosen after having been fed into the drill hole lies in the same in a mat or string with substantially even thickness; i.e. the drill hole may not be so much inclined that the explosive chosen will slide or move in the drill hole and be unevenly distributed therein. Such tendency to slide or move depends of course on the nature of the bulk explosive chosen.

Despite what has been stated hereinabove as to the desirability of achieving an even distribution of explosive, it may be mentioned that the operator, should he desire to have a larger amount of explosive at any location along the length of the drill hole, may move the tool 12 back and forth a few times so that locally a certain "packing effect" may be obtained.

Figure 3:
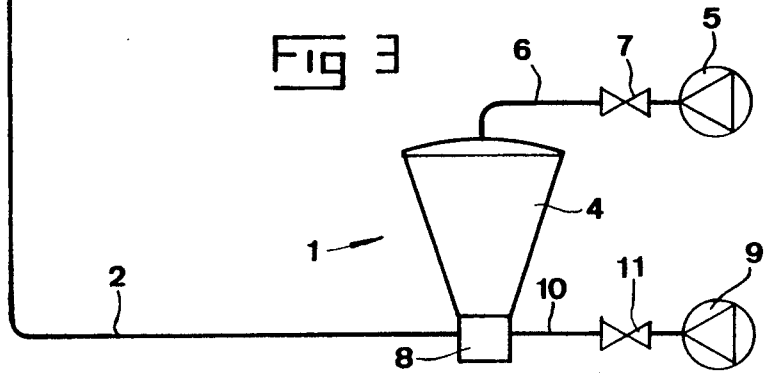
FIG. 3 is a view similar to FIG. 2 but illustrating the introduction in a somewhat later phase.
Figures 5, 6:
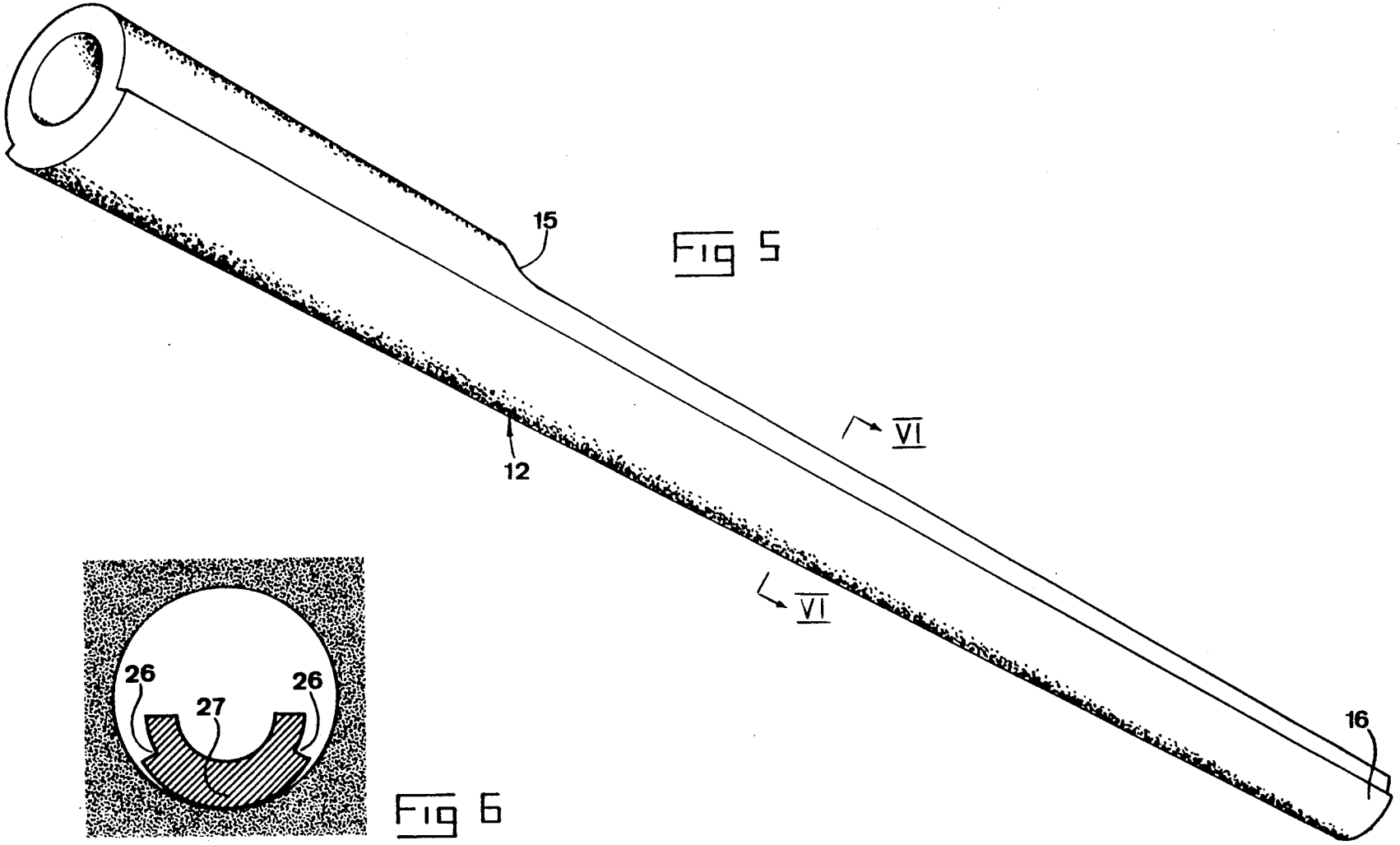
FIG. 5 is a perspective view of an embodiment of the tool modified somewhat in relation to FIG. 1.
FIG. 6 is a cross section of the tool in FIG. 5 introduced into a drill hole.

In FIGS. 5 and 6 an embodiment of the tool 12 is illustrated which corresponds to the one illustrated in FIGS. 1-3 except for the tool comprising at least between the discharge opening 15 and the extreme end 16 longitudinal channel like notches 26 at its sides. These notches 26 are intended to form channels, which on withdrawal of the tool out of the drill hole simplify air flow in the direction from the part of the tool located most adjacent to the mouth of the drill hole to its extreme end 16 so that the risk for negative pressure occurring thereat due to the withdrawal of the tool is reduced. The notches 26 extend here along the entire length of the tool 12 and are for instance formed in that the tool at its bottom portion has a section 27 with increased thickness.

Figure 7:
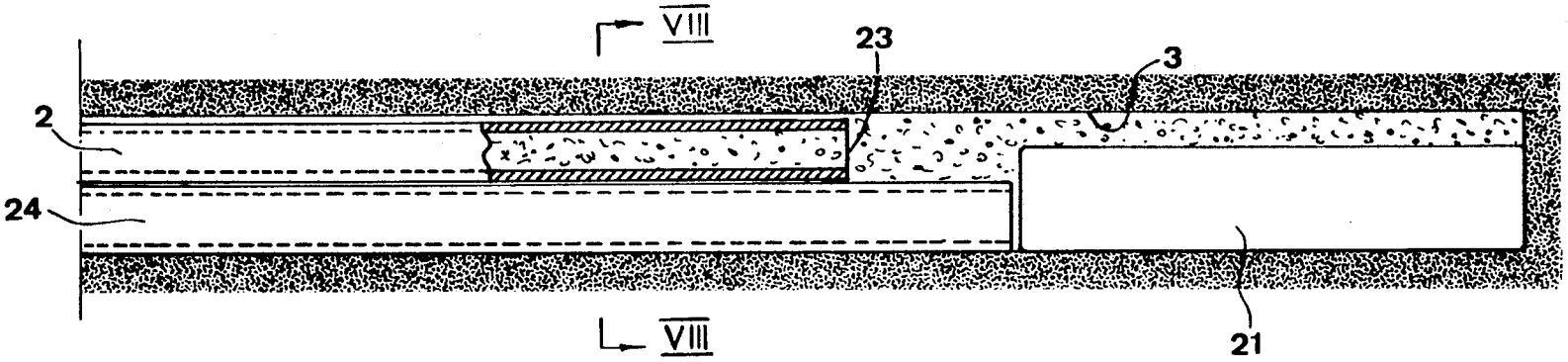
FIG. 7 is a partially cut side view illustrating introduction of explosive into a drill hole in an alternative embodiment of the invention.
Figure 8:
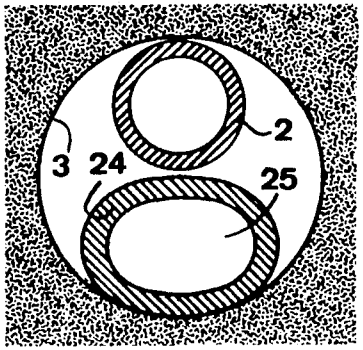
FIG. 8 is a cross section taken along the line VIII—VIII in FIG. 7.

In FIGS. 7 and 8 an embodiment of the invention is illustrated which may be used not only for horisontal drill holes but also for drill holes with inclination or entirely vertical orientation. The device comprises also in this embodiment the feeding arrangement 1 indicated in FIG. 3 and the feeding conduit 2, the extreme end of which is illustrated in FIG. 7. The conduit 2 does not, in this embodiment, comprise any tool 12 but terminates simply in an arbitrary discharge opening or nozzle 23. A detonator cartridge 21 is also here intended to initially be located at the bottom of the drill hole 3. However, the device comprises in this case elongated filler means, here in the form of at least one elongated filler body 24 adapted to be introduced into the drill hole to the bottom thereof or to abutment against the cartridge 21 and extend along the entire length of the drill hole. The body 24 is intended to remain located in the drill hole during feeding of the explosive by means of conduit 2 to provide by means of its volume a longitudinal drill hole portion, which is not filled by explosive and which extends along the entire length of the drill hole. The filler means consists of a non explosive material or of a material with explosive power neglectable for the blasting.

When the filler body 24, which preferably has a constant external cross section, is located in the drill hole, the conduit 2 is introduced to the vicinity of its bottom and feeding through the conduit is initiated. The space of the drill hole which is not filled by the body 24 will now entirely be filled with explosive fed through the conduit 2, which is successivly drawn backwardly during filling towards the mouth of the drill hole. When filling has been completed, the conduit 2 is entirely withdrawn leaving a longitudinal string of explosive in the drill hole. It should be remarked that the feeding pressure in the embodiment according to FIGS. 7 and 8 with preference may be considerably higher than in the embodiment previously described so that accordingly such packing of the explosive in the drill hole is achieved that the explosive does not tend to slide out of the same even if the drill hole would extend straightly upwardly. The filler body 24 may, in particular if it is intended to remain in the drill hole during blasting, consist of arbitrary combustible material. In order to save material, the body 24 may present an internal through hole 25, i.e. be tubular. The material of such a tube or in such a body 24 may be e.g. paper, cardboard or plastics. However, the body 24 could also consist of a homogeneous or possibly tubular wood piece. Two or more filler bodies 24 may of course be located in a row after each other.

The device may, however, also be such that the filler body 24 is intended to be withdrawn out of the drill hole prior to blasting. In such a case the body 24 should be formed by a single coherent piece, e.g. a plastics hose with required length. The internal through hole 25 in such a plastics hose will allow air passage so that withdrawal of the plastics hose is not made difficult by a negative pressure occurring within the drill hole due to the withdrawal. Since the explosive has been introduced into the drill hole with a relatively high feeding pressure, the same has in a considerable degree agglomerted so that little or no disturbance of the uniform distribution of the explosive along the length of the drill hole occurs on withdrawal of the filler body or hose 24. In order to simplify withdrawal of such a filler body 24 prior to blasting, the same may be designed with an external cross sectional area successivly decreasing in a direction towards the bottom of the drill hole. Such narrowing or conicity should be relatively small so as to make the distribution of the explosive along the length of the drill hole to deviate in an unessential extent from the truly uniform distribution and will considerably simplify withdrawal of the body.

In all embodiments described, the drill holes should be filled with explosive to not more than 90%, suitably not more than 75%, and preferably not more than 60%, of the drill hole volume.

It is evident that the invention may be modified in several ways within the scope of the inventive idea. It may for instance be pointed out that the cavity forming extreme portion 16 of the tool 12 does not need to have any successively growing increase of the cross sectional area by any sloping material portion 20 but the increase of cross sectional area may occur in one single or possibly several more or less transverse steps. For the rest, the increase of cross sectional area at the outer end of the tool 12 could possibly entirely be avoided so that accordingly the channel portion 19 would extend all along to the outer end of the tool, in which case the material portion defining the channel 19 would be formed with such a cross sectional area that it corresponded to the cross sectional area of the cavity 13 obtained in the drill hole after introduction of the explosive. Also other modifications are possible within the scope of the invention.

We claim:

1. A method for introducing explosives, in particular granular or pulverulent explosives, into a substantially horizontal drill hole, said introduction being carried out by means of a hoselike or tubelike conduit (2) introducible into the drill hole (3), the explosive being transported through said conduit, wherein, in order to obtain an explosive power reduced in relation to that obtained by a complete filling of the drill hole with explosive, only partial filling of the drill hole is carried out by providing the conduit (2) with a tool (12) connected to the conduit, said tool comprising a cavity forming portion (16), which is located behind a discharge opening (15) of the conduit as viewed in a withdrawal direction of the conduit from the drill hole and which is located at a substantial distance from the discharge opening (15), said tool, after feeding the explosive into the drill hole and subsequent withdrawal of the conduit from the drill hole, leaving an airfilled elongated cavity (13) in the drill hole with a mat of loose explosive along a bottom of the drill hole below the airfilled cavity.

2. A method according to claim 1, wherein the cross sectional area of the cavity forming portion (16) is chosen to yield the cross sectional area of the elongated cavity (13) in the drill hole, and the explosive is fed through the discharge opening (15) with a feeding pressure which is sufficiently low to maintain the cavity obtained behind the cavity forming portion (16), open with the explosive fed through the discharge opening freely falling over the cavity forming portion, the cavity forming portion being at the very end of the tool.

3. A method according to claim 1 or 2, wherein the drill hole (3) is filled with explosive to not more than 90%, of the drill hole volume.

4. A method according to claim 3 wherein the drill hole (3) is filled with explosive to not more than 60% of the drill hole volume.

5. A device for introduction of explosives, in particular granular or pulverulent explosives, into a substantially horizontal drill hole, said device comprising an arrangement (1) for feeding the explosive through a hoselike or tubelike conduit (2) having an internal diameter and which is introducible into the drill hole, wherein the device for obtaining an explosive power reduced in relation to that obtained by a complete filling of the drill hole with explosive is adapted for only partial filling of the drill hole by the conduit (2) being provided with a tool (12) connected to the conduit, said tool being in the form of a nozzle member and comprising a cavity forming portion (16), which is located behind a discharge opening (15) of the conduit as viewed in a withdrawal direction of the conduit from the drill hole and which is located at a distance from the discharge opening (15) which is at least ten times the internal conduit diameter, said tool after feeding of the explosive into the drill hole and being subsequently withdrawn from the drill hole, leaving an airfilled elongated cavity (13) in the drill hole with a mat of loose explosive at the bottom of the drill hole.

6. A device according to claim 5, wherein said cavity forming portion has a cross sectional area substantially determining the cross sectional area of the elongated cavity (13) in the drill hole.

7. A device according to claim 6, wherein the feeding arrangement (1) is adapted to feed the explosive through the conduit (2) and the discharge opening (15) with a feeding pressure adjusted or adjustable respectively sufficiently low to maintain on withdrawal of the conduit (2) the cavity obtained behind the cavity forming portion (16).

8. A device according to claim 7, characterized in that the tool, as viewed in its withdrawal direction, before the discharge opening (15) has a tubular portion (17), which at the discharge opening (15) merges into a channel shaped portion (19).

9. A device according to claim 5, wherein the tool, as viewed in its withdrawal direction, before the discharge opening (15) has a tubular portion (17), which at the discharge opening (15) merges into a channel shaped portion (19).

10. A device according to claim 9, wherein the channel shaped portion (19) at its end turned away from the discharge opening (15) comprises the cavity forming portion (16).

11. A device according to claim 10, wherein the cavity forming portion at or in the vicinity of an extreme end of the tool, has a cross sectional area exceeding that of the channel shaped portion (19).

12. A device according to claim 5, wherein the distance along the nozzle member between the cavity forming portion (16) and the discharge opening (15) is at least twenty times the internal conduit diameter.

13. A device according to claim 5, wherein the cavity forming portion contains a solid material portion (20) having an increasing cross sectional area in a direction away from the discharge opening (15) to the end of the cavity forming portion (16), the cavity forming portion being at the very end of the nozzle member and, at the end of the nozzle member, having the cross sectional area of the desired cavity (13) in the drill hole.

* * * * *